United States Patent [19]

Buffiere et al.

[11] 4,054,433

[45] Oct. 18, 1977

[54] INCORPORATED CASCADE COOLING CYCLE FOR LIQUEFYING A GAS BY REGASIFYING LIQUEFIED NATURAL GAS

[75] Inventors: Jean-Pierre Buffiere, Saint Mande; Gerard Vanderbussche, Fontenay-sous-Bois, both of France

[73] Assignee: L'Air Liquide, Societe Anonyme pour l'Etude et l'Exploitation des Procedes Georges Claude, Paris, France

[21] Appl. No.: 652,807

[22] Filed: Jan. 27, 1976

[30] Foreign Application Priority Data

Feb. 6, 1975 France ..... 75.04403

[51] Int. Cl.[2] ..... F25J 3/04

[52] U.S. Cl. ..... 62/13; 62/40; 62/50

[58] Field of Search ..... 62/13, 40, 50, 51

[56] References Cited

U.S. PATENT DOCUMENTS

| | | | |
|---|---|---|---|
| 2,895,304 | 7/1959 | Wucherer et al. | 62/13 |
| 3,479,832 | 11/1969 | Sarsten et al. | 62/40 |
| 3,707,849 | 1/1973 | Becker | 62/13 |
| 3,721,099 | 3/1973 | Forg et al. | 62/40 |
| 3,729,945 | 5/1973 | Linnett | 62/40 |
| 3,929,438 | 12/1975 | Harper et al. | 62/40 |

*Primary Examiner*—Norman Yudkoff
*Attorney, Agent, or Firm*—Young & Thompson

[57] ABSTRACT

The present invention relates to a cooling cycle which enables a gas to be liquefied as the result of the regasification of liquefied natural gas.

In accordance with the invention, the cooling cycle consists of an incorporated cascade cycle the heat source for which is formed by liquefied natural gas in the course of regasification, and the cooling load for which is formed by gas to be liquefied.

The invention is applicable to the production of liquid oxygen or nitrogen from a plant for separating air by liquefaction and distillation.

3 Claims, 2 Drawing Figures

INCORPORATED CASCADE COOLING CYCLE FOR LIQUEFYING A GAS BY REGASIFYING LIQUEFIED NATURAL GAS

BACKGROUND OF THE INVENTION

The present invention relates to a cooling cycle which allows a gas to be liquefied as a result of the regasification of liquefied natural gas. The invention also relates to a method of fractionating air by liquefaction and distillation, which employs a cooling cycle according to the invention to liquefy at least one gas fraction, such as gaseous nitrogen, resulting from the fractionating process.

The technical and economic context of the present invention is as follows:

Now that certain countries (in particular, the United States, Western Europe and Japan) have become vast consumers of energy, increasingly large amounts of natural gas have to be transported from producing countries (in particular the USSR, Africa, South America, etc.) to such consumer countries.

When the distances over which the natural gas has to be transported are excessively great, and when sea transport is feasible or inevitable, as it sometimes is, (for intercontinental transport), the natural gas is liquefied in the producing country, the liquefied natural gas (hereinafter referred to as LNG) is transported in ships designed for the purpose (methane carriers), and the LNG so transported is converted back into gas in the consumer country.

To this end, the following operations are carried out in the consumer country:

1. The LNG transported is received at specially designed harbour installations generally referred to as "terminals".
2. The LNG is stored in thermally insulated tanks at the terminals.
3. The LNG is regasified and compressed in suitable units at the terminal; the regasification may be accompanied by treatment of the LNG for the purposes of reducing its calorific value and/or extracting certain usable fractions which can be consumed separately (such as propane, and butane).
4. The regasified LNG, or natural gas (hereinafter referred to as NG), is piped from the terminal to places where it is used and consumed. It is generally piped at a high pressure (30 to 80 bars).

Generally, to regasify the LNG it is compressed in liquid form from its storage pressure (atmospheric pressure) to the supply pressure of the network for distributing the natural gas and it is then vaporised at this supply pressure. The heat required to vaporise the gas and then heat it to ambient temperature is provided by sea water. Compressing the LNG by means of pumps in the above way allows a double economy, both in capital investment and in the energy consumed by the regasification plant.

However, rather than lose for good the potential cooling energy contained in LNG, namely the amount of cooling energy which can be extracted from it when it is regasified, particularly by vaporising it and then heating its vapour, it is preferable to use at least a part of this cooling energy for useful purposes.

It has therefore been proposed that the lowest temperature, i.e., the "highest grade", cooling energy from the LNG should be used in installations for fractionating atmospheric air by liquefaction and distillation, with a view to obtaining at least one of the gaseous fractions produced, namely oxygen or nitrogen, in the liquid state. In effect, using the cold or cooling energy from the LNG allows the energy expended on liquefying such gaseous fraction or fractions to be reduced.

In general terms, to transfer the potential cooling energy contained in the LNG to the gaseous air fraction or fractions to be liquefied, a cooling cycle of the open or closed type is used in which the refrigerant may be nitrogen for example. Like all cooling cycles, this cycle may be looked upon as allowing:

Cooling energy to be extracted from a cold source (LNG in course of regasification) at graduated temperatures between an initial temperature (the temperature at which refrigeration begins to be taken from the LNG), which is at least equal to $-161°$ C, and a final temperature (the temperature at which refrigeration ceases to be extracted from the LNG), which is at most equal to ambient temperature, for example 0° C.

The refrigeration extracted from the cold source to be transferred to a cooling load (a gaseous fraction, or gas to be liquefied, which is in the course of being cooled, then liquefied, and possibly sub-cooled) at graduated temperatures between an initial temperature (the temperature at which the gaseous fraction or the gas to be liquefied begins to be cooled), which may be ambient temperature, and a final temperature (the temperature prevailing at the conclusion of the liquefaction and possibly the sub-cooling of the gaseous fraction), which is generally lower than the initial temperature at which refrigeration begins to be extracted from the LNG.

In general and simplified terms, such a cooling cycle consists of:

1. compressing a refrigerant (nitrogen for example) in gaseous form from a low pressure to a high pressure in one or more compression stages,
2. in cases where the high pressure is higher than the critical pressure of the refrigerant, cooling the compressed refrigerant, or, in cases where the high pressure is lower than the said critical pressure, cooling and then condensing the compressed refrigerant by means of heat exchange with the above-mentioned cold source (liquefied natural gas in course of regasification,
3. de-pressurising the cooled or condensed refrigerant isenthalpically in one or more de-pressurising stages, in other words bringing about a Joule-Thompson type de-pressurisation of the cooled or condensed refrigerant in one or more stages, in order to obtain a condensed refrigerant at low pressure,
4. when the cycle is a closed one, vaporising the condensed refrigerant and then heating it by heat exchange with the above mentioned cooling load (a gaseous fraction or gas to be liquefied in course of cooling and then liquefaction).

In the case of an open cycle (such as the liquefaction of gaseous nitrogen by means of a refrigerant formed by nitrogen), stage (4) defined above can be dispensed with since condensed gaseous nitrogen can be tapped off from the condensed refrigerant obtained in the course of stage (3) above.

From a purely thermodynamic point of view, the cooling cycle described above is irreversible at a substantial number of points, as is explained below in the case of the liquefaction of nitrogen by means of a refrigerant formed by nitrogen:

1. if consideration is restricted on the one hand to LNG in the course of vaporisation at a pressure lower than its critical pressure, and on the other hand to nitrogen in the course of condensation at a pressure lower than its critical pressure, the enthalpy curve (enthalpy H on the y- axis and temperature T on the x- axis) for LNG in the course of vaporisation is in the form of a long thermal gradient, while the enthalpy curve for nitrogen in the course of condensation is of a vertical nature. Under these circumstances it is in general difficult to achieve a match between the enthalpy curve for the refrigerant and on the one hand the special enthalpy curve for LNG and on the other hand the enghalpy curve for nitrogen, (i.e., ensure the minimum of irreversibility).

2. the Joule-Thomson de-pressurisation or de-pressurisations mentioned above are very far from being reversible. They in fact involve an expansion or change of volume on the part of the nitrogen which is de-pressurised, either because the nitrogen is de-pressurised in the gaseous or super-critical form or because it is de-pressurised in the liquid form and cannot be sufficiently sub-cooled before de-pressurisation thus causing a by no means negligible "flash" to be produced in the course of de-pressurisation.

For these two reasons, the effectiveness of the cooling cycle described above cannot be considered optimum.

The present invention thus has as a main object a cooling cycle which is different from that described above and which is particularly suited to the transferring cooling energy from a cold source formed by LNG in course of regasification to a cooling load formed by a gas to be liquefied which is in the course of being cooled, then condensed, and possibly sub-cooled, which gas to be liquefied may be a gaseous fraction resulting from fractionating air by liquefaction and distillation.

To be more exact, the present invention has as a main object a cooling cycle which enables the two thermodynamic irreversibilities mentioned above to be overcome.

The present invention is based on the following considerations and facts:

1. the cooling known as the "incorporated cascade", or "single-stream cascade", or "mixed refrigerant cascade", or again "mixed refrigerant", cycle may be used to cool liquefy, and possibly subcool natural gas (NG).

Such a cycle was for example the subject of a French Patent No. 1,302,989 filed in the name of L'Air Liquide and of its first certificate of addition no. 80,294 and its second certificate of addition no. 86,485.

Such a cycle may be defined in general terms as consisting of at least the following basic operations:

a. At least one cycle mixture, in gaseous form, consisting of a plurality of components is compressed from a low pressure to a high pressure, the compression taking place in at least one compression stage, b. At least the compressed cycle mixture is subjected to fractional condensation at the said high pressure, fractional condensation comprising at least:

b.1 A first fractional condensation stage during which at least the compressed cycle mixture is partially condensed by heat exchange with at least one external refrigerant. At least the partially condensed cycle mixture is separated into a first condensed fraction and a first vapour fraction which continues with the fractional condensation, b.2 A last fractional condensation stage during which a last vapour fraction of at least the cycle mixture is totally condensed by counter-current heat exchange with a refrigerant stream of the cycle mixture, which is in the course of heating at a vaporisation pressure at least equal to the low pressure. In this way is obtained a last condensed fraction, c. Parts at least of the first condensed fraction and of the last condensed fraction are de-pressurised from the said high pressure to the said vaporisation pressure, the de-pressurised part of the last condensed fraction forming at least an initial part of the said refrigerant stream, and at least the de-pressurised part of the first condensed fraction being combined with said refrigerant stream, d. The parts de-pressurised in stage (c) are vaporised and the said refrigerant stream is heated at the said vaporisation pressure by counter-current heat exchange with at least the cycle mixture which is in course of fractionated condensation at the high pressure, e. The gas to be liquefied is cooled by counter-current heat exchange with a cooling steam of the cycle mixture which is in the course of heating at a heating pressure equal to the said low pressure, and at least part of the said gas to be liquefied is withdrawn in the condensed state as liquid product, f. At least the refrigerant stream which has been heated in stage (d) is recompressed as in stage a. from the said vaporisation pressure to the said high pressure to again form at least part of the cycle mixture at the high pressure.

In a similar way to the cycle discussed above, this cycle may be looked upon as allowing:

refrigeration to be extracted from a cold source formed by the said external refrigerant, which consists of a single component and is in the course of heating (water for example), or in the course of vaporisation at one or more vaporisation pressures, (propane for example), and thus refrigeration to be extracted at one temperature and one only (as in the case of propane in the course of vaporisation at a single vaporisation pressure for example) or at temperatures distributed along a relatively short temperature gradient (as in the case of water in the course of heating of propane in the course of vaporisation at a plurality of vaporisation pressures for example), the refrigeration extracted from the hot source to be transferred to a cooling load (NG in the course of being cooled, and then liquefied and possibly sub-cooled) at temperatures distributed along a relatively long temperature gradient (in order to cool, and then liquefy and possibly sub-cool the NG), 2. from the thermodynamic point of view, the advantage of the incorporated cascade cycle when applied to the liquefaction of NG lies in the fact that, since there are a plurality of components in the cycle mixture, on the one hand the special enthalpy curve for the NG or cooling load (in the course of cooling then liquefying and possibly sub-cooling), whether it is combined (in the case of a closed cycle involving only one vaporisation pressure for the cycle mixture) or not (in the case of a closed cycle involving two vaporisation pressures for the cycle mixture) with the enthalpy curve for the cycle mixture in the course of fractional condensation, and on the other hand the enthalpy curve for the cycle mixture in the course of vaporisation and heating at the low pressure of the cooling cycle, can be made to match (i.e., irreversibility can be brought to a minimum), 3. conversely, if consideration is now given on the one hand to LNG in the course of re-gasification, for which the enthalpy curve is of a similar, if not identical, form to the enthalpy curve for the cooling, liquefaction and possibly sub-cooling of the original NG, and on the other hand to a cycle mixture such as that described above when in the course of fractional condensation at a high pressure, for which the enthalpy curve is similar in form to that for the vaporisation and heating of the same mixture at a low vaporisation pressure, it will be realised that it ought to be possible for a counter-current heat exchange between on the one hand LNG in the course of regasification and possibly a cycle mixture in the course of vaporisation and heating, and on the other hand this same cycle mixture in the course of fractional condensation, to take place with a minimum of thermodynamic irreversibility.

SUMMARY OF THE INVENTION 4. consequently, the present invention proposes that an incorporated cycle be used to transfer cooling energy from LNG in course of regasification to a gas to be liquefied, on condition that the following adaptations are made:

the cold source for the cycle is now formed by LNG in the course of regasification and not by an external refrigerant such as water or propane. Consequently, the refrigeration is now extracted from cold source at temperatures which are distributed along a relatively long temperature gradient from at least the temperature at which the LNG begins to be regasified to the temperature at which this regasification ends, the cooling load for the cycle is now formed by the gas to be liquefied when in the course of cooling and then condensation and possible sub-cooling, and not by NG to be liquefied. Consequently, in cases where only a pure gas, i.e., one consisting of only one component, is condensed, the refrigeration transferred to the cooling load is extracted at one single temperature, or along a relatively short temperature gradient.

In other words, referring to the general definition of an incorporated cascade cycle which is given above, a cycle according to the invention is characterised in that, the said external refrigerant being formed by liquefied natural gas in the course of regasification, during at least the first stage (b1) of fractional condensation a counter-current heat exchange takes place between on the one hand at least the compressed cycle mixture which is in the course of fractional condensation and on the other hand the liquefied natural gas which is in the course of regasification.

Thus, it is found that when an incorporated cascade cycle is applied to the regasification of LNG, in contrast to the same cycle when applied to the liquefaction of NG, on the one hand the longer heat transfer gradient is transposed from the cooling load to the cold source, and on the other hand the shorter heat transfer gradient is transposed, at least in its broad essentials, from the cold source to the cooling load.

5. When used to regasify LNG, an incorporated cascade cycle enables the problem which existed previously to be solved, due to the facts that:

as explained above, the enthalpy curve for the fractional condensation of the cycle mixture can be matched to the enthalpy curve for the regasification of the LNG, as in any incorporated cascade cycle, the Joule-Thomson de-pressurisations may be performed on sub-cooled liquids and thus with virtually no expansion of the fluid which is de-pressurised.

As will be seen below, in accordance with the invention the incorporated cascade cycle which is employed may be either of the open or closed type. In the case of a closed cycle, the cycle may involve only one vaporisation pressure for the cycle mixture, which is substantially equal to the low pressure of the cycle, or two vaporisation pressures for the cycle mixture which are substantially equal to, respectively, the low pressure of the cycle, and a pressure intermediate between this low pressure and the high pressure of the said cycle.

DEFINITIONS

The following terms will be understood as defined below throughout the present description and the accompanying claims:

A. "GAS TO BE LIQUEFIED": As examples, the following fall within the definition: a gaseous mixture consisting of a plurality of pure components or substances, a pure gas consisting of only one pure component or substance which it is desired to condense wholly or partially, and substantially pure gaseous nitrogen or a substantially pure gaseous nitrogen fraction produced by distilling air. In cases where the gas to be liquefied is a mixture of gases, the mixture may be condensed in a fractional manner.

B. "CYCLE MIXTURE": a mixture consisting of a plurality of pure components or substances which may or may not be physically identifiable, flowing in circuit in an incorporated cascade cooling cycle, the sole function of which is cyclically to extract cooling energy from the cold source (liquefied natural gas in course of regasification) and to transfer the refrigeration extracted from the cold source to the cooling load (gas to be liquefied in the course of cooling), C. "EXTERNAL REFRIGERANT": when not liquefied natural gas, a refrigerant from a source external to the incorporated cascade cooling cycle. Inter alia, such an external refrigerant may be used firstly to pre-cool the gas to be liquefied, secondly to cool the cycle mixture when in the gaseous state and compressed at high pressure and, before its fractional condensation, and thirdly to cool the cycle mixture when compressed at the high pressure with a view to assisting its partial, preliminary condensation (the beginning of the fractional condensation) which takes place in accordance with the inventiion by heat exchange with LNG in the course of regasification. Such an external refrigerant may be a liquid such as water in the course of being heated, or a liquid refrigerant such as propane in the course of vaporisation at one or more vaporisation pressures. In the latter case any other external refrigerant equivalent to propane may be used. This may for example mean a mixture of pure substances (such as propane and propylene) or one and the same pure substance (such as butane). It may also mean ammonia or the fluorinated hydrocarbon refrigerants known as "Freons". Also in the latter case, the incorporated cascade cooling cycle may co-operate with another cooling cycle, or auxiliary cooling cycle, which allows the external refrigerant to be recondensed after evaporation and which involves successively compressing the external refrigerant after vaporisation, condensing the compressed external refrigerant by heat exchange with another external refrigerant such as water, de-pressurising the condensed external refrigerant, and vaporising the de-pressurised external refrigerant by heat exchange for example with the compressed cycle mixture at the high pressure before its fractional condensation, the said evaporated external refrigerant being then cycled back to compression, "COMPOSITION": unless indicated to the contrary, the composition in terms of volume of a gas or liquid which is imagined to be totally vaporised, expressed in molar or volumetric percentages, "COMPOSITION OF THE CYCLE MIXTURE": the composition in terms of volume of the cycle mixture. In the case of an incorporated cascade cycle of the closed type the composition which is analysed and measured may be that of the compressed cycle mixture in the high pressure gaseous state, before its partial preliminary condensation (the beginning of the fractional condensation by heat exchange with LNG in the course of regasification. In the case of an incorporated cascade cycle of the open type, the cycle mixture proper cannot be measured and analysed as such. In this case the composition of the cycle mixture may be calculated by adding up the quantities of the various components of the cycle mixture contained in the various condensed fractions of the said mixture which are de-pressurised to the low pressure of the cycle and returned to the point where the cycle mixture is compressed, "TO COOL" or "COOLING": unless indicated to the contrary in any particular case any operation performed on a gas by which heat is extracted from the said gas. Such cooling involves at least one of the following processes when the said gas is at a pressure lower than its critical pressure:

1. cooling the said gas from an initial temperature near to or lower than ambient temperature to a final temperature equal to or higher than the dew point of the said gas, the gas remaining in the gaseous state,
2. wholly or partly condensing the said gas when initially it is at its dew point. In cases where a gas consisting of only one component is wholly or partly condensed, condensation takes place at a substantially constant temperature. In cases where a gas consisting of a plurality of components is wholly or partly condensed, condensation takes place by lowering the temperature of the said gas from its dew point to a temperature higher than or equal to its boiling point. In cases where a gas consisting of a plurality of components is condensed, condensation may take place in a fractional fashion,
3. sub-cooling the condensed gas, or at least a condensed fraction of the said gas in cases where the gas has been subjected to fractional condensation, the sub-cooling taking place by lowering the temperature of the said gas, or the temperature of at least the said condensed fraction, from an initial temperature close to the boiling point of the said gas or the said condensed fraction to a final temperature.

G. "FRACTIONAL CONDENSATION": an operation consisting of at least:

a. a first fractional condensation stage during which a gas (such as the cycle mixture in the compressed gaseous state) is partially condensed by heat exchange with at least one refrigerant. The partially condensed gas is separated into a first condensed fraction, and a first vapour fraction which continues with the fractional condensation, b. possibly at least one intermediate fractional condensation stage during which the first vapour fraction, or a vapour fraction from the preceding stage of fractional condensation, is partially condensed by heat exchange with at least one refrigerant. The vapour fraction which is partially condensed in this way is separated into a second condensed fraction, or penultimate condensed fraction, and a second vapour fraction, or last vapour fraction, which continues with the fractional condensation, c. a last fractional condensation stage during which the last vapour fraction is wholly condensed by heat exchange with a refrigerant, as a result of which a last condensed fraction is obtained.

In the case of the fractional condensation of the cycle mixture, the number of fractional condensation stages is equal to the number of separating drums which separate a condensed fraction and a vapour fraction, plus one.

"TO HEAT" and "HEATING": unless otherwise indicated in any particular case, any operation carried out on a liquid or a two-phase mixture of liquid and gas, by means of which heat is given up to the said liquid or to the said two-phase mixture. Such heating involves at least one of the following processes:

1. entire or partial vaporisation of the said liquid or the said two-phase mixture, which is initially at the boiling point of the said liquid or the said two-phase mixture. When the said liquid contains a plurality of components, or when the said two-phase mixture contains a plurality of components, during this entire or partial vaporisation the temperature of the said liquid or the said two-phase mixture is increased from the said boiling point to a temperature lower than or equal to the dew point of the said liquid or the said two-phase mixture. When the said liquid or the said two-phase mixture is formed by a single pure substance vaporisation takes place at one and the same temperature.
2. heating of the said liquid once vaporised or the said two-phase mixture once vaporised from a dew point of the said liquid or two-phase mixture once vaporised to a final temperature close to or lower than ambient temperature.

The two-phase mixture discussed above may be subjected to a plurality of successive vaporisations as described above, each of which represents the introduction into the said mixture of a liquid. The same applies to the refrigerant and cooling streams of the cycle mixture which are discussed below.

I. "REGASIFY" and "REGASIFICATION": the act of adding heat to liquefied natural gas with the object of converting it from the liquid state to the gaseous state. When the liquefied natural gas is regasified at a pressure lower than its critical pressure, the regasification consists of heating as defined above.

J. "REFRIGERANT STREAM" and "COOLING STREAM", streams of the cycle mixture which are intended to cool respectively the said cycle mixture in the course of fractional condensation, and the gas to be liquefied. These streams both flow from the cold end to the hot end of a heat-exchange assembly and initially, that is to say at the cold end of the said heat-exchange assembly, are the result of introducing at least a de-pressurised part of a condensed fraction of the cycle mixture into the said heat-exchange assembly and then vaporising it, which fraction, in the course of the progress of the said stream towards the hot end of the said heat-exchange assembly, is joined by at least a de-pressurised part of at least one other condensed fraction of the cycle mixture.

In the case of an incorporated cascade cycle of the open type, the bringing together of at least a part of the gas to be liquefied and at least a part of the cycle mixture may take place either at the low pressure, for example at the point where the cycle mixture is drawn in for compression, or at the high pressure, for example at the point where the cycle mixture is delivered from compression or in the course of fractional condensation of the cycle mixture, or finally at a pressure intermediate between the high and low pressures of the cooling cycle, for example in the course of the compression of the cycle mixture.

BRIEF DESCRIPTION OF THE DRAWINGS

The present invention will now be described, with reference to the accompanying drawings, in which.

DETAILED DESCRIPTION OF PREFERRED EMBODIMENTS

Figure 1:
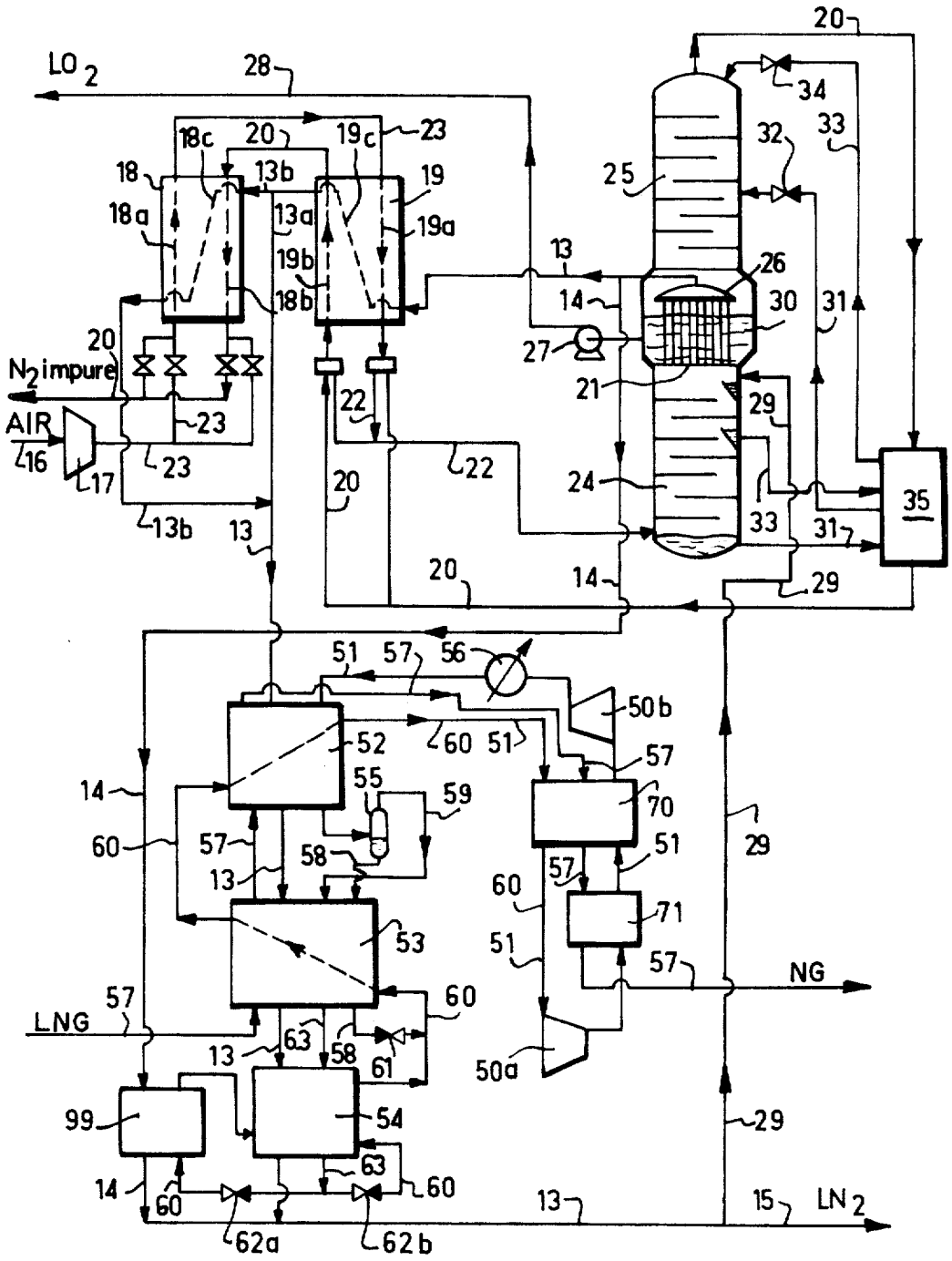
FIG. 1 shows an installation consisting of two parts, namely: a plant for fractionating air by liquefaction and distillation, which is shown in the upper part of the Figure, and a plant for liquefying a substantially pure gaseous nitrogen fraction, or gas to be liquefied, resulting from the fractionating of air, which is shown in the lower part of the Figure.

The cooling cycle according to the invention which is shown in FIG. 1 is an incorporated cascade cycle which has the following general characteristics:

- it is of the closed type.
- it involves only one vaporisation pressure for the cycle mixture, which is equal to the low pressure of the cooling cycle. - the fractional condensation of the cycle mixture takes place in two stages, namely a first fractional condensation stage and a last fractional condensation stage.

In the description which follows temperatures are given in degrees C, pressures in absolute atmospheres or atmas (1 atma = 1.013 bars = 1013 × N/m²) and throughputs are given in standard cubic meters per hour or Nm³/h, that is to say at standard conditions of temperature and pressure.

In the liquefaction cycle shown in FIG. 1, at least the following operations are carried out:

a. in a compressor 50 a cycle mixture 51 in gaseous form (i.e. 815Nm³) is compressed, at a temperature of −30° C, from a low pressure equal to 2.5 atmas to a high pressure equal to 40.5 atmas. The cycle mixture contains three components namely, 68.11% nitrogen, 19.94% methane, and 11.95% ethylene. The compression at 50 takes place in a first compression stage (in compressor 50*a*) from the low pressure to an intermediate pressure equal to 10 atmas, and in a last compression stage (in compressor 50*b*) from the intermediate pressure to the high pressure.

b. In cooler 56 the compressed cycle mixture is cooled to a temperature of 35° C by means of a flow of an external refrigerant such as water which is in course of heating. By means of heat exchangers 52, 53 and 54 and separator 55, fractional condensation is performed on the compressed cycle mixture which has been cooled to 35° C at 56. This fractional condensation consists of:

b1. a first fractional condensation stage during which the compressed cycle mixture is partially condensed in exchanger 52 by counter-current heat exchange between on the one hand the compressed cycle mixture in the course of fractional condensation, and on the other hand liquefied natural gas 57 in course of regasification (the external refrigerant). To be more exact, 636.64 Nm³ of the liquefied natural gas 57 is vaporised in exchanger 52, at a pressure of 30 atmas, in countercurrent to the compressed cycle mixture 51, at the same time as it is heated to a temperature equal to − 61° C. In separator 55 the partially condensed cycle mixture is separated into a first condensed fraction 58 (i.e., 782.4 Nm³) and a first vapour fraction 59 (i.e., 32.6 Nm³), which latter continues with the fractional condensation. The equilibrium temperature in separator 55 is − 87° C.

b2. A last fractional condensation stage, carried out by exchangers 53 and 54, during which the first and last vapour fraction 59 (i.e., 782.4 Nm³) of the cycle mixture is wholly condensed by counter-current heat-exchange in exchanger 53 with a refrigerant stream 60 (i.e., 815 Nm³) of the cycle mixture, which is in the course of heating at a vaporisation pressure equal to the low pressure mentioned above. To be more precise, refrigerant stream 60 is in the course of vaporisation in exchanger 53 because of the vaporisation of the first condensed fraction 58, which is depressurised in depressurising valve 61 and combined with refrigerant stream 60. At the outlet from exchanger 53 there is thus obtained a last condensed fraction 63 of the cycle mixture at a temperature of − 149° C. / This last condensed fraction 63 is sub-cooled in heat exchanger 54 by counter-current heat exchange with the same refrigerant stream 60 in the course of vaporisation which stream is the result of the vaporisation of the last condensed fraction 63 after it has first been depressurised in de-pressurising valves 62*a* and 62*b*.

c. The whole of first and last condensed fractions 58 and 63 are depressurised from the high pressure to the vaporising pressure of the cycle mixture, which is equal to the aforementioned low pressure. This takes place in depressurising valve 61, and depressurising valves 62*a* and 62*b*, respectively. The last condensed fraction 63, which is depressurised in valves 62*a* and 62*b*, forms the initial part of the aforementioned refrigerant stream 60, and the first condensed fraction 58, which is depressurised in valve 61, is combined with the aforementioned refrigerant stream 60.

d. The condensed fractions 58 and 63 which are depressurised in stage (c) are vaporised in exchangers 53 and 54 respectively, and, in broad terms, the refrigerant stream 60 is heated (as defined above for a two phase liquid/gas mixture), at a vaporisation pressure equal to the low pressure of the cycle, by counter-current heat exchange (in exchangers 52, 53 and 54) with the cycle mixture 51 which is in the course of fractional condensation (as defined above) at the high pressure.

e. The gas 13 to be liquefied is cooled (in the meaning of the term defined above) at a pressure of 6 atmas from an initial temperature of 14° C to a final temperature of −176.5° C by counter-current heat exchange (in exchangers 52, 53, 54) with a cooling stream of the cycle mixture which is identical to the refrigerant steam 60 mentioned above and which is in the course of heating at a heating pressure equal to the low pressure of the cooling cycle. A part of the gas 13 to be liquefied, which is obtained in the condensed state at the outlet of exchanger 54, is withdrawn as liquid product 15.

f. The refrigerant steam 60 which was heated in stage (d) above to a temperature equal to − 60° C is recompressed in compressors **50*a* and 50*b*, as in stage (a) above, from the aforementioned vaporisation pressure, which is thus equal to the low pressure of the cycle, to the aforementioned high pressure, with the object of again forming at least part of the cycle mixture 51** at the high pressure.

The cycle described above being of the closed type, it can be seen that during the fractional condensation stage (b) for the cycle mixture 51 and the cooling stage (e) for the gas to be liquefied 13, the cycle mixture 51 and the gas 13 to be liquefied are not combined and are thus cooled in exchangers 52, 53 and 54 independently of and separately from one another.

The cycle described above has the following features also:

1. During the first fractional condensation stage (b1) described above, for which exchanger 52 and separator 55 are responsible, a counter-current heat exchange (in exchanger 52) takes place between on the one hand the compressed cycle mixture 51 in the course of fractional condensation, and on the other hand the refrigerant stream 60 in the course of heating.
2. In the same way, during the last fractional condensation stage (b2), for which exchanger 53 is responsible, a counter-current heat exchange takes place in exchanger 53 between on the one hand the first and last vapour fraction 59 of the cycle mixture, which is in the course of total condensation, and on the other hand the refrigerant stream 60 in the course of heating.
3. During the last fractional condensation stage (b2) described above, a counter-current heat exchange takes place (in exchanger 53) between on the one hand the first and last vapour fraction 59 of the cycle mixture, which is in the course of total condensation, and on the other hand liquefied natural gas 57 in the course of regasification. To be more exact, when it passes through exchanger 53 the liquefied natural gas 57 is in the process of being heated in liquid form, whereas it partially vaporises when passing through heat exchanger 52, because of which the liquefied natural gas 57 which is extracted from exchanger 52 at a temperature of − 61° C is partially vaporised.

From FIG. 1 it can also be seen that:

- In the course of the vaporisation and heating stage (d) described above, the refrigerant stream 60 is heated to a temperature of less than − 40° to − 30° C and specifically to − 61° C.

- In the course of the recompression stage (f) described above, the refrigerant stream 60 is recompressed in an initial compression stage, which takes place in compressor **50*a*, and in a final compression stage, which takes place in compressor 50*b***, the pressure being raised in the two stages from the vaporisation pressure of the cycle mixture, which is equal to the low pressure, to the intermediate pressure, and from the latter to the high pressure of the cooling cycle, respectively.

- In exchanger 70 a counter-current heat exchange takes place between on the one hand the refrigerant stream 60 which is heated in stage (d), before it reaches the initial compression stage **50*a*, and on the other hand the cycle mixture 51 at the intermediate pressure, before it reaches the final compression stage 50*b*. In this way, the refrigerant stream 60 is re-heated to approximately − 40° to − 30° C, and specifically to − 30° C, before undergoing the initial compression stage 50*a*, and the cycle mixture 51 at the intermediate pressure is cooled to approximately − 40° to − 30° C, and specifically to − 30° C, before undergoing the final compression stage 50*b***.

Furthermore the cycle mixture 51 at the intermediate pressure is also cooled by counter-current heat exchange (in exchangers 70 and 71) with the liquefied natural gas 57 in the course of regasification, which takes place before the final compression stage **50*b*. To be more exact, the liquefied natural gas completes its vaporisation in exchanger 70, and the vaporised natural gas is heated to 30° C in exchanger 71**.

It can also be seen that the liquefied natural gas which is in the course of regasification by counter-current heat exchange (in exchangers 70 and 71) with the cycle mixture 51 at the intermediate pressure, is that which was previously used to partially condense (in exchanger 52) the high-pressure cycle mixture 51 in stage (b1).

By way of example, with the throughputs for the various streams quoted above, the liquefaction cycle described calls for an amount of power of the order of 95.35kW to be expended on compression. The composition of the cycle mixture may be adapted to that of the LNG in the course of regasification and/or to that of the gas to be liquefied.

In general terms, the cycle mixture has the following characteristics, either separately or in combination:

a. it contains between 0 and approximately 20% of hydrocarbons containing a number of carbon atoms at least equal to three, i.e., $C_{3+}$ hydrocarbons.
b. it consists of at least nitrogen and a hydrocarbon containing two carbon atoms, namely ethane or ethylene.
c. it also contains methane.
d. it consists of firstly between 0 and approximately 40% methane, secondly between approximately 5 and 30 percent of the hydrocarbon having two carbon atoms (ethylene or ethane), and thirdly between approximately 40 and 95% nitrogen.

In accordance with the invention, the incorporated cascade cooling cycle may be of the closed type and may involve two different vaporisation pressures for the cycle mixture. Such a cycle is then characterised by the following features:

1. In the course of the compression stage (a) described above, the cycle mixture 51 is compressed in two compression stages **50*a* and 50*b*** in which pressure is raised respectively from the low pressure to an intermediate pressure, and from the intermediate pressure to the high pressure of the cycle.

2. In the course of the fractional condensation stage (*b*) and the vaporisation and heating stage (*d*) described above, the vaporisation pressure for the refrigerant stream 60 is substantially equal to the aforesaid intermediate pressure.

3. In the course of the stage (*e*) described above for cooling the gas to be liquefied, another cooling stream, which is different and separate from refrigerant stream 60 and is in the course of heating at a heating pressure equal to the low pressure of the cycle, is used, which is carried out in order to cool the gas to be liquefied by counter-current heat exchange with the said cooling stream.

In the course of the de-pressurising stage (*c*) described above, another part of each of the two condensed fractions obtained in stage (*b*) (namely the first condensed fraction 58 and the last condensed fraction 63) is de-pressurised to the intermediate pressure. This other, de-pressurised part of one of the two condensed fractions, the last condensed fraction for example, forms at least an initial part of the aforementioned cooling stream, and this same part of the other of the two condensed fractions, namely the first condensed fraction, is combined with the above-mentioned cooling stream.

4. In the course of the recompression stage (*f*) the heated cooling stream is recompressed from the low pressure to the intermediate pressure, and the heated refrigerant stream 60 which has been combined with the stream is recompressed from the intermediate pressure to the high pressure of the cooling cycle.

Figure 2:
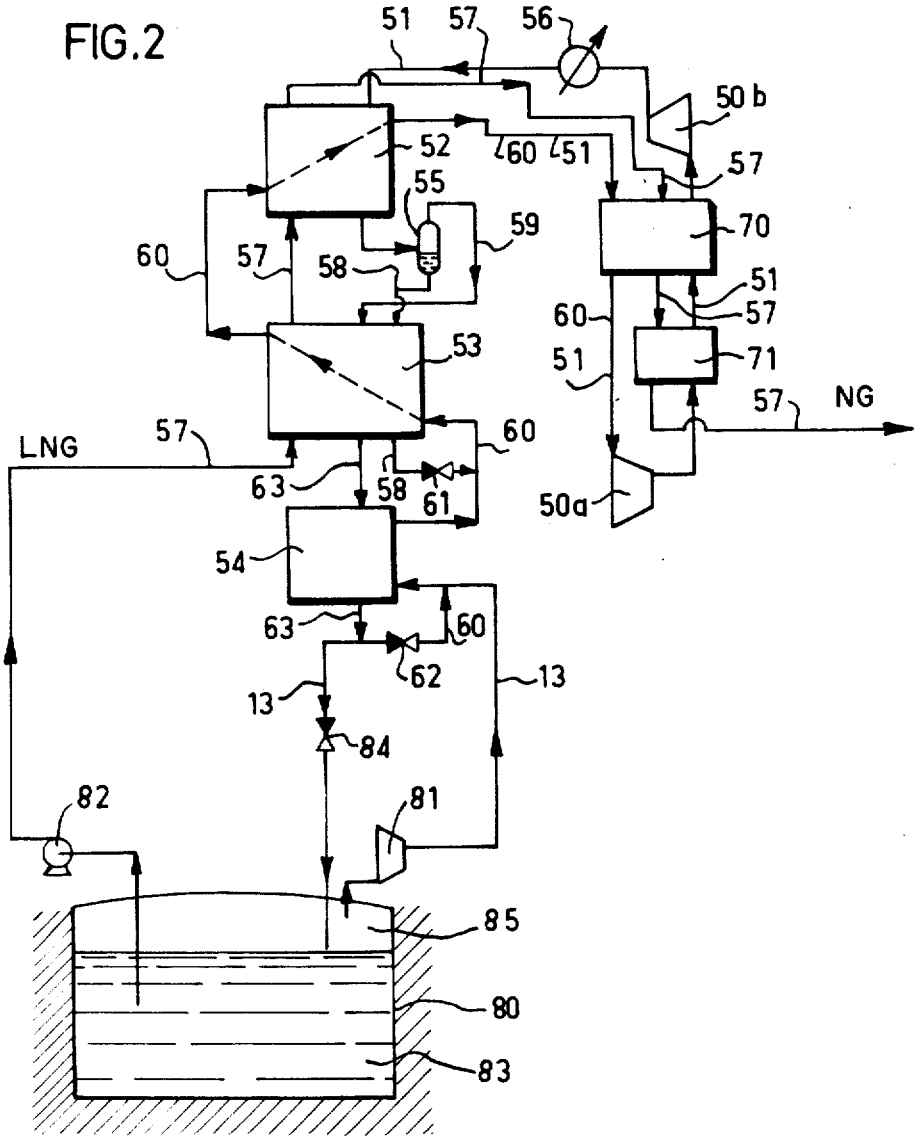
FIG. 2 shows a cycle for liquefying a gas which is similar to that shown in FIG. 1 but of the open type, and which enables vapours from an underground reservoir of liquefied natural gas to be re-liquefied as a result of the re-vaporisation of the liquefied gas.

In FIG. 2 there is shown a cooling cycle similar to that described with reference to FIG. 1, but of the open type. This cycle enables vapours 85 from an underground store 80 of LNG 83 to be reliquefied by making use of a quantity of refrigeration derived from the regasification of the LNG 83.

The same reference numerals are used in FIG. 2 to refer to the same elements and streams as are found in the cycle described with reference to FIG. 1.

In comparison with the cooling cycle in FIG. 1, that in FIG. 2 has the following features:

1. The gas 13 to be liquefied (the vapours 85 to be reliquefied) is combined, by means of a blower 81, with the refrigerant stream 60, before being heated in exchangers 54, 53 and 52 in stage (*d*). Consequently, the gas 13 to be liquefied is combined with the cycle mixture 51 before the latter experiences fractional condensation in stage (*b*) described above. The gas to be liquefied could also be combined with the cycle mixture during its fractional condensation in stage (*b*). In this way, on the one hand the first and last fractionated condensation stages described above take place in fractional condensation stage (*b*) by condensing a mixture consisting of the gas to be liquefied (vapours 85) and the cycle mixture 51, and on the other hand the stage (*e*) of cooling the gas 13 to be liquefied merges totally with fractional condensation stage (*b*) for the cycle mixture 51, the cooling stream mentioned in stage (*e*) also being identical with the refrigerant stream 60 which is encountered in stages (*b*), (*c*), (*d*), and (*f*).

2. A part of the last condensed fraction 63 obtained in stage (*b2*) described above is withdrawn from the cooling cycle by means of de-pressurising valve 84 and returned to storage tank 80 as liquid product.

3. The liquefied natural gas 83 is compressed in liquid form in pump 82 before being regasified in line 57.

There will now be described with reference to FIG. 1, the air fractionating method which is employed by the air-separating plant shown, which cooperates with the cooling cycle described with reference to FIG. 1.

The fractionating method in question consists of at least the following operations:

a'. In a compressor 17, air 16 is compressed to a so-called higher pressure equal to 6.27 atmas.

b'. In a reversible heat-exchange assembly 18, 19, which has a hot part 18 and a cold part 19, the compressed air 23 is cooled from a high temperature equal to +30° C to a low temperature equal to −171° C by countercurrent heat exchange with on the one hand a nitrogen-rich gas fraction 20, which is obtained from the distillation in stage (*d'*) described below and which is in the course of being heated, at a so-called lower pressure equal to approximately 1.1 atmas, from a low temperature equal to −175° C to a high temperature equal to +27° C, and on the other hand with a part 13 to be liquefied of a substantially pure gaseous nitrogen fraction 21 which is obtained in the course of distillation in stage (*d'*) below. A portion 13*b* of the part 13 to be liquefied is heated in in the reversible heat-exchange assembly 18, 19 from a low temperature equal to −175° C to a high temperature of +27° C, and a portion 13*a* of the part 13 to be liquefied is heated in the cold part 19 of the reversible heat-exchange assembly 18, 19 from a temperature of −175° C to a temperature of −75° C. The portion 13*a* of the part 13 to be liquefied, and the portion 13*b* of this same part which is further heated, are then combined to form the gaseous nitrogen 13 (i.e., 409.76 $Nm^3$ at a temperature of 14° C) which is brought together in stage (e) described above with the residual gaseous fraction 14 at the low pressure of the nitrogen liquefaction cycle.

The way in which the reversible heat-exchange assembly 18, 19 operates will now be described in greater detail.

c'. in the course of the cooling in stage (*b'*) above which takes place in the reversible heat exchange-assembly 18, 19, the compressed air 23 is cleaned of water and carbon dioxide gas by a cooling process. In other words, the water and carbon dioxide gas are separated out by condensation and solidification in reversible heat exchange-assembly 18, 19, the impurities which are trapped in this way being then removed by vaporisation and sublimation in the nitrogen-rich gaseous fraction 20 which is in course of being heated.

d'. the cooled and cleaned compressed air 22 is distilled by means of a distillation column having two stages 24 and 25 which operate at, respectively, the higher pressure, i.e., approximately 6.2 atmas, and the lower pressure i.e., approximately 1.3 atmas, and by condensing at least part of a substantially pure gaseous nitrogen fraction 21, which is obtained at −176.5° C at the top of the higher-pressure stage 24, in a condenser and evaporator 26 which forms a thermal link between columns 24 and 25, by heat exchange with a substantially pure liquid oxygen fraction 30 which is obtained at −178.7° C at the bottom of the lower-pressure stage 25 and which is at least partly in course of vaporisation.

To be more exact, the stream of cooled and cleaned compressed air 22 is introduced at the bottom of stage 24. In column 24 there are separated out firstly an oxygen-rich liquid 31 containing 38.9% oxygen, which is collected at −172° C at the bottom of the stage, and secondly an oxygen-deficient liquid 33 containing 4.9% oxygen which is collected at −175.9° C, at an intermediate level of stage 24 higher up than the rich liquid 31. From the top of stage 24 is obtained a substantially pure gaseous nitrogen fraction 21 at a temperature of −176.5° C and at least part of this is condensed in condenser and evaporator 26 as described above.

The oxygen rich liquid 31 is sub-cooled to a temperature of −175.9° C, and the oxygen deficient liquid 33 to a temperature of −189.4° C, by countercurrent heat exchange in exchanger 35 with the nitrogen-rich fraction 20 which is in course of heating from −192.8° C to −175° C. The sub-cooled oxygen rich liquid 31 and the sub-cooled oxygen deficient liquid 33 are de-pressurised to the lower pressure in de-pressurising valves 32 and 34 respectively.

The de-pressurised oxygen rich liquid 31 and the de-pressurised oxygen deficient liquid 33 are introduced into distillation stage 25 at an intermediate level and at the top thereof respectively, by which means, as a result of the distillation of the infed liquids 31 and 33, there are obtained in stage 25 on the one hand the nitrogen-rich gaseous fraction 20 (containing 96.8% nitrogen) at the top of the column at a temperature of −193.2° C, and on the other hand the substantially pure liquid oxygen fraction 30 at the bottom of the stage at a temperature of −178.7° C.

The substantially pure gaseous nitrogen fraction 20 is heated in exchanger 35 and reversible heat-exchange assembly 18, 19, as described above, while at least part of the substantially pure liquid oxygen fraction 30 is removed from stage 25, compressed in pump 27 to a pressure of 3.5 atmas and discharged as a product through duct 28.

In general terms, by a nitrogen or oxygen-rich gaseous or liquid fraction is meant a substantially pure liquid or gaseous fraction consisting of nitrogen or oxygen, or a gaseous or liquid fraction whose nitrogen or oxygen content is greater than that of atmospheric air.

In order to enable the air-separating plant described above to co-operate with the liquefaction cycle described above with reference to FIG. 1, the following adaptions are made:

1. The gas 13 to be liquefied is cooled in stage (e) of the liquefaction cycle at a pressure substantially equal to the higher pressure in the air-fractionating process, i.e., approximately 6 atmas.

2. The gas 13 to be liquefied is formed by that portion 13 which is to be liquefied of the substantially pure gaseous nitrogen fraction 21 which is obtained from the top of the higher pressure stage 24. At least part of this portion to be liquefied is heated in reversible heat-exchange assembly 18, 19 by heat exchange with the compressed air 23 in the course of cooling before it is cooled in stage (*e*) of the liquefaction cycle.

Of the gas 13 to be liquefied which is obtained in the condensed state in the cooling stage (*e*) defined above another portion 29 is withdrawn as reflux. This reflux 29 is fed to the top of the higher pressure stage 24.

To be more exact, since the compressed air 23 is cleaned by a cooling process, the reversible heat-exchange assembly 18, 19 has, on the one hand two pairs of interchangeable passages 18*a*, 19*a*, and 18*b*, 19*b*, which are reserved for, respectively, the compressed air 23 which is in the course of cooling and cleaning in stages (*b'*) and (*c'*), and the nitrogen-rich gaseous fraction 20 at the lower pressure which is in the course of heating in stage (*d'*), and on the other hand a pair of non-interchangeable passages 18*c*, 19*c*, which are reserved for the portion 13 to be liquefied.

In this way, after the portion 13 to be liquefied has been heated in non-interchangeable passage 19*c* in the cold part 19 of reversible heat-exchange assembly 18, 19 it is divided into two parts 13*a* and 13*b*, one (13*b*) of which is again heated in non-interchangeable passage 18*c* in the hot part 18 of reversible heat-exchange assembly 18, 19, and the other (13*a*) of which is not heated again. The part 13*b* which is heated again and the part 13*a* which is not heated again are reunited with one another to form the part to be liquefied, which is heated as a whole to the temperature of −4° C and which is cooled in stage (*e*) of the cooling cycle.

In addition, another portion 14 to be liquefied, which is extracted from the substantially pure gaseous nitrogen fraction 21 which is obtained at the top of the higher pressure stage 24, is cooled directly to a temperature of −176.5° C, that is to say without preliminary heating, by countercurrent heat exchange in exchanger 99 with the cooling or refrigerant stream 60, while in the condensed state, this other part 14 to be liquefied is recombined with the part 13 to be liquefied, which is likewise in the condensed state.

The present invention is applicable wherever oxygen or nitrogen, chiefly in liquid form, is produced in association with a plant for regasifying liquefied natural gas with the object of feeding the natural gas so obtained into a distribution network.

We claim:

1. A process for fractionating air, utilizing a supply of stored liquefied natural gas and a cycle of the incorporated cascade type, comprising a. constituting at least one cycle mixture consisting of a plurality of components at least one of which is sufficiently volatile so as to have a boiling temperature which at the low pressure of the cycle is lower than the temperature of said stored liquefied natural gas;

b. compressing said at least one cycle mixture, in gaseous phase, from said low pressure to a high pressure, said compression taking place in at least one compression stage;

c. fractionally condensing at least the compressed cycle mixture at said high pressure, said fractional condensing comprising at least:

c1. a first fractional condensation stage during which at least the compressed cycle mixture is partially condensed by heat exchange partially with at least one external refrigerant and partially with said liquefied natural gas in the course of reheating, and at least the partially condensed cycle mixture is separated into a first condensed fraction and a first vapor fraction which continues with the fractional condensation, c2. at least one intermediate fractional condensation stage during which a previously separated vapor fraction of said cycle mixture is partially condensed by counter-current heat exchange with a refrigerant stream comprising a part of said cycle mixture in the course of revaporisation at said low pressure and said liquefied natural gas in the course of regasification and reheating, c3. a last fractional condensation stage during which the last vapor fraction comprising said at least one volatile component of at least the cycle mixture is wholly condensed by countercurrent heat exchange with a refrigerant stream which at least in its final step is exclusively constituted by a part of the cycle mixture which is in the course of heating at said low pressure, so as to obtain a last condensed fraction, d. the gas to be liquefied is cooled by counter-current heat exchange with a cooling stream of the cycle mixture which is in the course of being vaporized and heated at a heating pressure equal to the said low pressure, and during said at least one intermediate fractional condensation by countercurrent heat exchange with said liquefied natural gas in the course of regasification and reheating, and at least a part of said gas to be liquefied is withdrawn in the condensed state as liquid product, e. at least the refrigerant stream which has been heated in stage (d) is recompressed in the manner set forth in stage (b) from said low vaporization pressure to the said high pressure, in order to form again at least part of the cycle mixture at the high pressure, a'. the air is compressed to a pressure termed the higher pressure, b'. the compressed air is cooled by heat exchange with at least one nitrogen-rich gaseous fraction which is obtained from the distillation step (d') and which is in the course of reheating at a pressure termed the lower pressure, c'. the compressed air is cleaned of water and carbon-dioxide gas, d'. the cooled and cleaned compressed air is distilled, by means of at least two distillation stages which operate at said higher pressure and said lower pressure respectively, by condensing at least part of a substantially pure gaseous nitrogen fraction which is obtained from the top of said higher pressure stage, by heat exchange with a substantially pure liquid oxygen fraction which is obtained at the bottom of said lower-pressure stage and which is at least partly in the course of evaporation, at least the said nitrogen-rich gaseous fraction and a substantially pure oxygen fraction being obtained at the said lower pressure, and wherein furthermore:

i. the gas to be liquefied is cooled in said stage (e) of the liquefaction cycle at a pressure substantially equal to said higher pressure, and ii. the gas to be liquefied is formed by a portion to be liquefied of the substantially pure gaseous nitrogen fraction which is obtained from the top of the high-pressure stage, this portion to be liquefied being heated before being cooled in said stage (e), by heat exchange with the compressed air in the course of cooling, wherein of the gas to be liquefied which is obtained in the condensed state in said cooling stage (3), another portion is withdrawn as reflux and this reflux is fed to the top of said higher-pressure stage.

2. A process for fractionating air, utilizing a supply of stored liquefied natural gas and a cycle of the incorporated cascade type, comprising a. constituting at least one cycle mixture consisting of a plurality of components at least one of which is sufficiently volatile so as to have a boiling temperature which at the low pressure of the cycle is lower than the temperature of said stored liquefied natural gas;

b. compressing said at least one cycle mixture, in gaseous phase, from said low pressure to a high pressure, said compression taking place in at least one compression stage;

c. fractionally condensing at least the compressed cycle mixture at said high pressure, said fractional condensing comprising at least:

c1. a first fractional condensation stage during which at least the compressed cycle mixture is partially condensed by heat exchange partially with at least one external refrigerant and partially with said liquefied natural gas in the course of reheating, and at least the partially condensed cycle mixture is separated into a first condensed fraction and a first vapor fraction which continues with the fractional condensation, c2. at least one intermediate fractional condensation stage during which a previously separated vapor fraction of said cycle mixture is partially condensed by countercurrent heat exchange with a refrigerant stream comprising a part of said cycle mixture in the course of revaporisation at said low pressure and said liquefied natural gas in the course of regasification and reheating, c3. a last fractional condensation stage during which the last vapor fraction comprising said at least one volatile component of at least the cycle mixture is wholly condensed by countercurrent heat exchange with a refrigerant stream which at least in its final step is exclusively constituted by a part of the cycle mixture which is in the course of heating at said low pressure, so as to obtain a last condensed fraction, d. the gas to be liquefied is cooled by countercurrent heat exchange with a cooling stream of the cycle mixture which is in the course of being vaporized and heated at a heating pressure equal to the said low pressure, and during said at least one intermediate fractional condensation by countercurrent heat exchange with said liquefied natural gas in the course of regasification and reheating, and at least a part of said gas to be liquefied is withdrawn in the condensed state as liquid product, e. at least the refrigerant stream which has been heated in stage (d) is recompressed in the manner set forth in stage (b) from said low vaporization pressure to the said high pressure, in order to form again at least part of the cycle mixture at the high pressure, a'. the air is compressed to a pressure termed the higher pressure, b'. the compressed air is cooled by heat exchange with at least one nitrogen-rich gaseous fraction which is obtained from the distillation in step (d') and which is in the course of reheating at a pressure termed the lower pressure, c'. the compressed air is cleaned of water and carbon-dioxide gas, d'. the cooled and cleaned compressed air is distilled, by means of at least two distillation stages which operate at said higher pressure and said lower pressure respectively, by condensing at least part of a substantially pure gaseous nitrogen fraction which is obtained from the top of said higher pressure stage, by heat exchange with a substantially pure liquid oxygen fraction which is obtained at the bottom of said lower-pressure stage and which is at least partly in the course of evaporation, at least the said nitrogen-rich gaseous fraction and a substantially pure oxygen fraction being obtained at the said lower pressure, and wherein furthermore:

i. the gas to be liquefied is cooled in said stage (e) of the liquefaction cycle at a pressure substantially equal to said higher pressure, and ii. the gas to be liquefied is formed by a portion to be liquefied of the substantially pure gaseous nitrogen fraction which is obtained from the top of the high-pressure stage, this portion to be liquefied being heated before being cooled in said stage (e), by heat exchange with the compressed air in the course of cooling, wherein said compressed air is cleaned by a cooling process by means of at least one reversible heat-exchange assembly which has on the one hand two pairs of interchangeable passages which are reserved for, respectively, the compressed air in the course of cooling and cleaning in said steps (b') and (c'), and the nitrogen-rich gaseous fraction at the lower pressure which is in the course of heating in said step (d'), and on the other hand a pair of non-interchangeable passages which are reserved for the said portion to be liquefied, and furthermore comprising the following steps:

i. after heating of said portion to be liquefied in the cold part of said reversible heat-exchange assembly, it is divided into two parts, one of which is again heated in the hot part of said reversible heat-exchange assembly and the other of which is not heated again, and ii. the part which is heated again and the part which is not heated again are reunited with one another to form again the said portion to be liquefied which is cooled in said stage (e) of the liquefaction cycle.

3. A process for fractionating air, utilizing a supply of stored liquefied natural gas and a cycle of the incorporated cascade type, comprising a. constituting at least one cycle mixture consisting of a plurality of components at least one of which is sufficiently volatile so as to have a boiling temperature which at the low pressure of the cycle is lower than the temperature of said stored liquefied natural gas;

b. compressing said at least one cycle mixture, in gaseous phase, from said low pressure to a high pressure, said compression taking place in at least one compression stage;

c. fractionally condensing at least the compressed cycle mixture at said high pressure, said fractional condensing comprising at least:

c1. a first fractional condensation stage during which at least the compressed cycle mixture is partially condensed by heat exchange partially with at least one external refrigerant and partially with said liquefied natural gas in the course of reheating, and at least the partially condensed cycle mixture is separated into a first condensed fraction and a first vapor fraction which continues with the fractional condensation, c2. at least one intermediate fractional condensation stage during which a previously separated vapor fraction of said cycle mixture is partially condensed by countercurrent heat exchange with a refrigerant stream comprising a part of said cycle mixture in the course of revaporisation at said low pressure and said liquefied natural gas in the course of regasification and reheating, c3. at last fractional condensation stage during which the last vapor fraction comprising said at least one volatile component of at least the cycle mixture is wholly condensed by countercurrent heat exchange with a refrigerant stream which at least in its final step is exclusively constituted by a part of the cycle mixture which is in the course of heating at said low pressure, so as to obtain a last condensed fraction, d. the gas to be liquefied is cooled by countercurrent heat exchange with a cooling stream of the cycle mixture which is in the course of being vaporized and heated at a heating pressure equal to the said low pressure, and during said at least one intermediate fractional condensation by countercurrent heat exchange with said liquefied natural gas in the course of regasification and reheating, and at least a part of said gas to be liquefied is withdrawn in the condensed state as liquid product, e. at least the refrigerant stream which has been heated in stage (d) is recompressed in the manner set forth in stage (b) from said low vaporization pressure to the said high pressure, in order to form again at least part of the cycle mixture at the high pressure, a'. the air is compressed to a pressure termed the higher pressure, b'. the compressed air is cooled by heat exchange with at least one nitrogen-rich gaseous fraction which is obtained from the distillation in step (d') and which is in the course of reheating at a pressure termed the lower pressure, c'. the compressed air is cleaned of water and carbon-dioxide gas, d'. the cooled and cleaned compressed air is distilled, by means of at least two distillation stages which operate at said higher pressure and said lower pressure respectively, by condensing at least part of a substantially pure gaseous nitrogen fraction which is obtained from the top of said higher pressure stage, by heat exchange with a substantially pure liquid oxygen fraction which is obtained at the bottom of said lower-pressure stage and which is at least partly in the course of evaporation, at least the said nitrogen-rich gaseous fraction and a substantially pure oxygen fraction being obtained at the said lower pressure, and wherein furthermore:

i. the gas to be liquefied is cooled in said stage (e) of the liquefaction cycle at a pressure substantially equal to said higher pressure, and ii. the gas to be liquefied is formed by a portion to be liquefied of the substantially pure gaseous nitrogen fraction which is obtained from the top of the high-pressure stage, this portion to be liquefied being heated before being cooled in said stage (e), by heat exchange with the compressed air in the course of cooling, wherein another portion to be liquefied of the substantially pure gaseous nitrogen fraction which is obtained at the top of said higher-pressure stage is cooled directly in the course of said cooling stage (e) by countercurrent heat exchange with said cooling stream, and this other portion to be liquefied, in the condensed stage, is recombined with the said part to be liquefied, which is likewise in the condensed state.

* * * * *